United States Patent [19]

Wright

[11] Patent Number: 4,964,629

[45] Date of Patent: Oct. 23, 1990

[54] KARATE KICK EXERCISE APPARATUS

[76] Inventor: Jerry F. Wright, 718 Manfield Dr., Newark, Del. 19713

[21] Appl. No.: 321,100

[22] Filed: Mar. 9, 1989

[51] Int. Cl.[5] ..... A63B 69/00; A63B 21/06

[52] U.S. Cl. ..... 272/76; 272/117; 272/94

[58] Field of Search ..... 272/76, 96, 97, 903, 272/117, 118, 70, 146, 94, 116; 128/25 R, 25 B

[56] References Cited

U.S. PATENT DOCUMENTS

| | | | |
|---|---|---|---|
| 2,542,074 | 2/1951 | Bierman | 272/96 |
| 4,139,193 | 2/1979 | Felber et al. | 272/903 |
| 4,781,372 | 11/1988 | McCormack | 272/70 |
| 4,807,874 | 2/1989 | Little | 272/118 |
| 4,811,941 | 3/1989 | Elo | 272/97 |

*Primary Examiner*—Stephen R. Crow
*Attorney, Agent, or Firm*—Mortenson & Uebler

[57] ABSTRACT

Apparatus useful in practicing a karate kick is provided. The apparatus includes a frame, a vertically adjustable platform affixed externally to the frame, a rotatable slide assembly having a forward end and a rear pivot end, the rear pivot end being affixed to the frame adjacent the platform, the slide assembly extending internally within the frame. A foot slide block assembly is slideably engaged in the slide assembly so as to slide from an initial rest position adjacent the rear pivot end to a final fully-extended position adjacent the forward end of the slide assembly. The foot slide block assembly has a resistance mechanism affixed to the slide block which resists movement of the slide block assembly from the initial rest position to the final fully-extended position, whereby, when a user stands on one foot on the platform, suitably adjusted for the user's height and places his other foot on the slide block in the initial position and gives a kick, the slide block slides in the slide assembly to the final position restrained by the resistance means, thereby giving the user exercise for those muscles specifically associated with the kick.

11 Claims, 3 Drawing Sheets

10
68
70
80
82
72
76
18
22
20
78
16
15
74
60
42
44
36
39
38
58
46
54
56
69
14
74
64
68
76
72
63
62
70
12

12
54
56
10
44
46
48
42
16
52
6
14
15
72
78
76
77
20
30
24
28
26
40
22
32
34
41
18
80
82
58
60
63
62
64
70
66
69
68
36
39
38

Fig. 6.
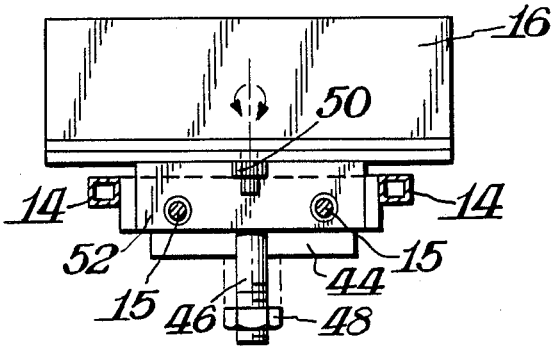
Fig. 3
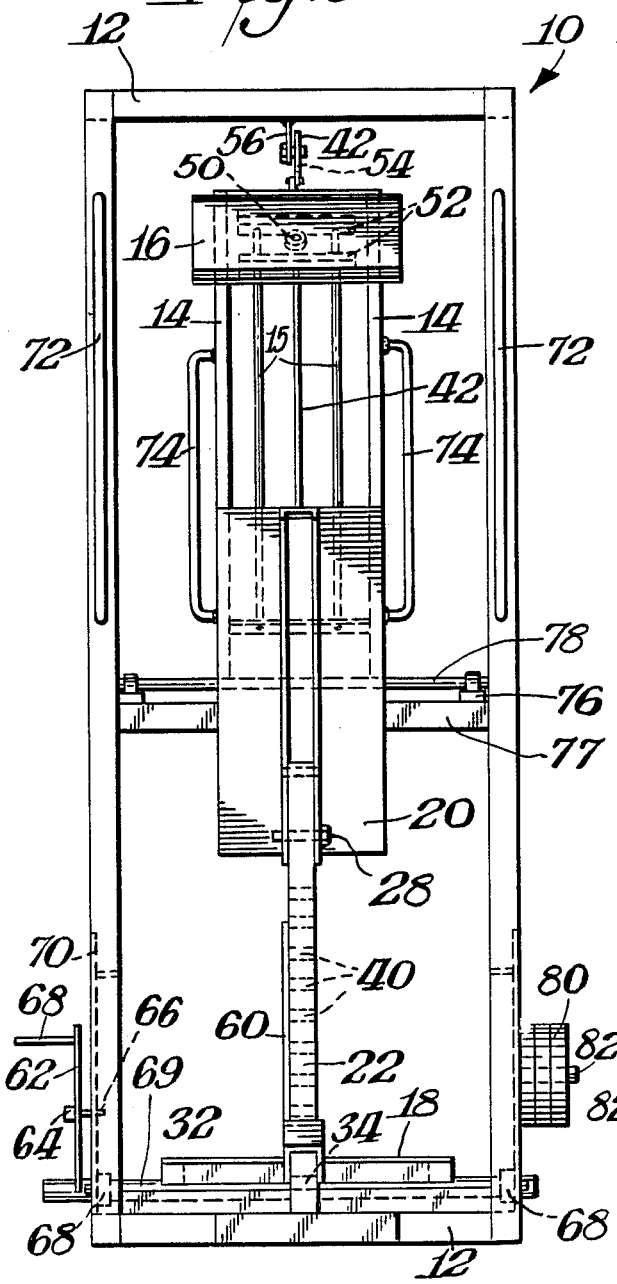
Fig. 4.

12
56
54
42
46
16
10
72
20
30
24
26
28
40
22
80
18
32
34
70
62
46
69
58
42
54
36
39
41
68
64
60
12
38

KARATE KICK EXERCISE APPARATUS

BACKGROUND OF THE INVENTION

This invention relates to apparatus useful in practicing a karate kick.

Karate is a system of self-defense, of Japanese origin, characterized by blows to the body of an adversary by the side of the open hand or by a kick with the bare foot.

During recent years, a variety of different types of exercising devices or machines have been developed for exercising and strengthening certain groups of muscles in the body. For stretching the leg muscles, there is a device available which progressively extends the legs in a "spread eagle" or "split" configuration. Several patents have issued for various of these devices, including U.S. Pat. Nos. 4,621,807, 4,577,861, 4,509,746, 4,353,546, 4,316,608, 4,296,924, 4,229,002, 3,866,914, 3,861,675 and 3,000,632.

However, there is no known exercise device which enables the user to actually practice a karate kick which places a desirable and adjustable resistance force against such a kick, and which thereby provides the user exercise for those muscles specifically associated with the kick.

SUMMARY OF THE INVENTION

Apparatus useful in practicing a karate kick is provided comprising a frame, a vertically adjustable platform affixed externally to the frame, a rotatable slide assembly having a forward end and a rear pivot end, the rear pivot end affixed to the frame adjacent the platform, the slide assembly extending internally within the frame, foot slide block means slideably engaged in the slide assembly so as to slide from an initial rest position adjacent the rear pivot end to a final fully-extended position adjacent the forward end of the slide assembly, resistance means affixed to the slide block assembly which resist movement of the slide block assembly from the initial rest position to the final fully-extended position. When a user stands on one foot on the platform, suitably adjusted for the user's height, and places his other foot on the slide block in the initial position and gives a kick, the slide block slides in the slide assembly to the final position restrained by the resistance means, thereby giving the user exercise for those muscles specifically associated with the kick. The resistance means preferably comprises a chain and pulley assembly, one end of the chain affixed to the forward end of the rotatable slide assembly, the chain being directed from the forward end upwardly to and through a pulley affixed to the frame, thence directed around the frame through one or more pulleys downwardly, and then returning upwardly to the foot slide block means, the other end of the chain being affixed thereat. The apparatus has means for adjusting the rotatable slide assembly to an initial rest position outwardly and downwardly from the user at an angle of about 45° continuously adjustable to an initial rest position outwardly and upwardly from the user at an angle of about 45°. The apparatus may have weights affixed to the forward end of the rotatable slide assembly to increase the kick resistance. The platform is preferably horizontally adjustable also. The platform preferably has a generally upwardly oriented, padded backrest affixed thereto, and means for adjusting the slant angle of the backrest with respect to the vertical. The foot slide block means may have additional swivel means.

BRIEF DESCRIPTION OF THE DRAWINGS

FIGS. 3 and 4 are front and rear elevational views, respectively, of the apparatus according to the invention.

FIG. 6 is a view of the foot slide block means of the invention taken substantially along line 6—6 of FIG. 1.

DETAILED DESCRIPTION OF THE INVENTION AND PREFERRED EMBODIMENTS WITH REFERENCE TO THE DRAWINGS

Apparatus useful in practicing a karate kick is provided. The apparatus includes a frame, a vertically adjustable platform affixed externally to the frame, a rotatable slide assembly having a forward end and a rear pivot end, the rear pivot end being affixed to the frame adjacent the platform, the slide assembly extending internally within the frame. A foot slide block assembly is slideably engaged in the slide assembly so as to slide from an initial rest position adjacent the rear pivot end to a final fully-extended position adjacent the forward end of the slide assembly. The foot slide block assembly has a resistance mechanism affixed to the slide block which resists movement of the slide block assembly from the weight of the user's leg and slide assembly (with or without weights added) and the natural resistance of the user's amount of flexibility pushing against himself from the initial rest position to the final fully-extended positon, whereby, when a user stands on one foot on the platform, suitably adjusted for the user's height, and places his other foot on the slide block in the initial position and gives a kick, the slide block slides in the slide assembly to the final position which will be determined by the preset angle of the slide assembly, the length of the user's leg and the ability to overcome the resistance means and his own flexibility level or resistance, thereby giving the user exercise and stretch in a vertical position for those muscles specifically associated with the kick.

Figure 1:
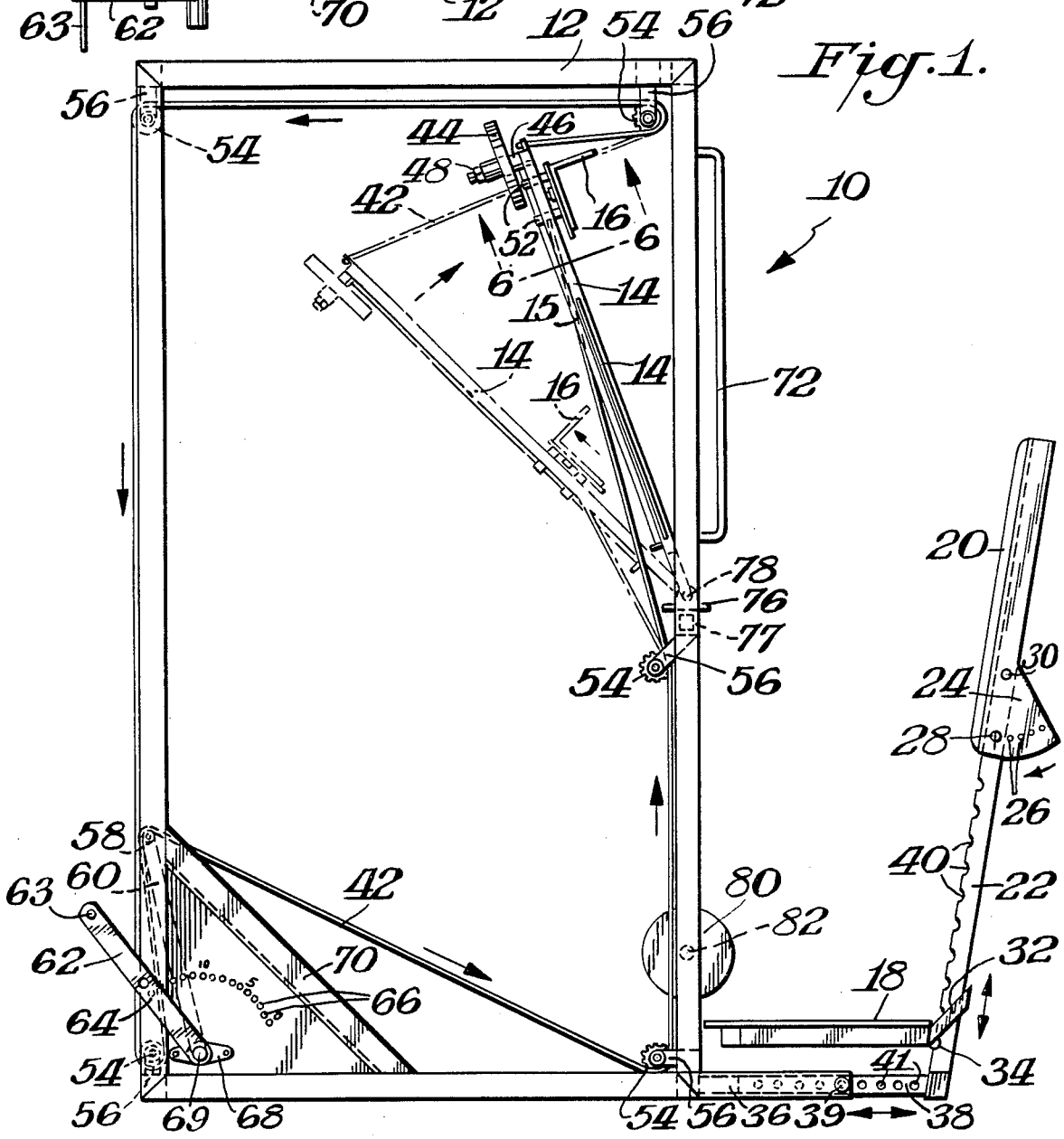
FIG. 1 is a side elevation of the apparatus according to the invention in the most difficult configuration in which to exercise.

A detailed description of the invention and preferred embodiments is best provided with reference to the accompanying drawings wherein FIG. 1 is a side elevational view of the apparatus 10 according to the invention in the most difficult configuration in which to exercise. Unless otherwise noted or is otherwise apparent, the components of the apparatus 10 are metal, preferably steel or aluminum.

To frame 12 is attached vertically adjustable platform 18, upon which a user, not shown, stands. The platform 18 is supported by support 22 extending upwardly as shown and having padded backrest 20 affixed thereto. The platform 18 is vertically adjustable, as indicated by the double-pointed arrow, by means of bracket 32, notches 40 and keeper 34. With this vertical adjustment mechanism, the height of platform 18 can be adjusted to compensate for and accomodate the height of any user. The backrest 20 can be tilted as desired by means of backrest angle adjustment bracket 24. The backrest pivots on pin 30. It may be tilted as desired and fixed at the required angle by placing pin 28 in the appropriate opening 26.

The platform 18, which is affixed to frame 12 by means of female coupling 36, welded to frame 12, and male bar stock 38, is horizontally adjustable as indicated by the double-pointed arrow. Horizontal adjustment is accomplished by removing pin 39, making the desired horizontal adjustment, and reinserting pin 39 in the appropriate opening 41.

The initial configuration of the slide assembly is phantom in FIG. 1. The slide assembly brackets 14 extend from a forward end within frame 12 to a rear, pivot end affixed to frame 12 by means of cross-member 77, bearings 76 and bearing rod 78, all to be discussed more fully below.

The slide assembly during use as shown in FIG. 1 rotates as indicated by the arrow from the initial position shown in phantom to the final position shown in solid lines. Additional weights 44, shown in phantom, may be placed on the forward end of the slide assembly to increase kick resistance by means of weight bolt 46 and weight nut 48. Additional weights 80 are conveniently affixed to frame 12 by means of weight pin 82.

The foot slide block means 16 slides along the slide assembly during use from an initial position shown in phantom to a final position shown in solid lines 90° maximum from horizontal. The foot slide block assembly is mounted on slide bearings 52 through which slide rods 15, not visible in FIG. 1, extend. Handles 72 on frame 12 and 74 on the slide assembly can help the user to maintain his balance and maximum forward lean.

Tension means 42 are affixed to the forward end of the slide assembly as shown. Tension means 42 is preferably a chain, and a #40 chain is suitable. The chain 42 extends from the forward end of the slide assembly upwardly through pulley or sprocket 54 held to frame 12 by bracket 56 and is guided around frame 12 by the additional pulleys or sprockets 54 as shown, all affixed to frame 12 by brackets 56. The chain 42 then extends upwardly toward the pivot end of the slide assembly and is affixed to the foot slide block assembly 16.

The initial position (angle from the user's vertical) is adjusted by means of take-up arm 60 in cooperation with stretch lever 62, which are in fixed angular relation with respect to each other. Pin 64 is removed from openings 66 and the stretch lever 62 is set at the desired stretch setting, maximum in FIG. 1, and the pin 64 is reinserted into the appropriate opening 66. At the end of take-up arm 60 is idler sprocket or pulley 58 over which chain 42 passes. In the position shown, chain 42 is at maximum tension raising the slide assembly to its maximum initial angle, extending outwardly and upwardly from said user at an angle of about 45°.

The take-up arm 60 and stretch lever 62 are held in support bracket 70 by end bearings 68 and cross bearing rod 69.

The apparatus of the invention may be used to exercise either the right or left leg and foot, buttocks, hips, lower back, upper back, shoulders and arm muscles (when pulling oneself toward and over the leg being exercised). Desired weights 44 may be added to the slide assembly as indicated in FIG. 1. In use, the user first makes the desired vertical, horizontal and angular adjustments to the platform 18 and backrest 20 so as to be in a comfortable position with his crotch vertically positioned slightly above the pivot end of the slide assembly. Grasping handles 72 if necessary, the user stands on one foot and places his other foot in foot slide block means 16. When in position, the user gives a kick forcing the foot slide block means 16 to slide outwardly as indicated by the arrow and the slide assembly to rotate upwardly to the final position as shown, all resisted by tension means 42 and weights 44. This exercise may be repeated as often as desired.

Figure 2:
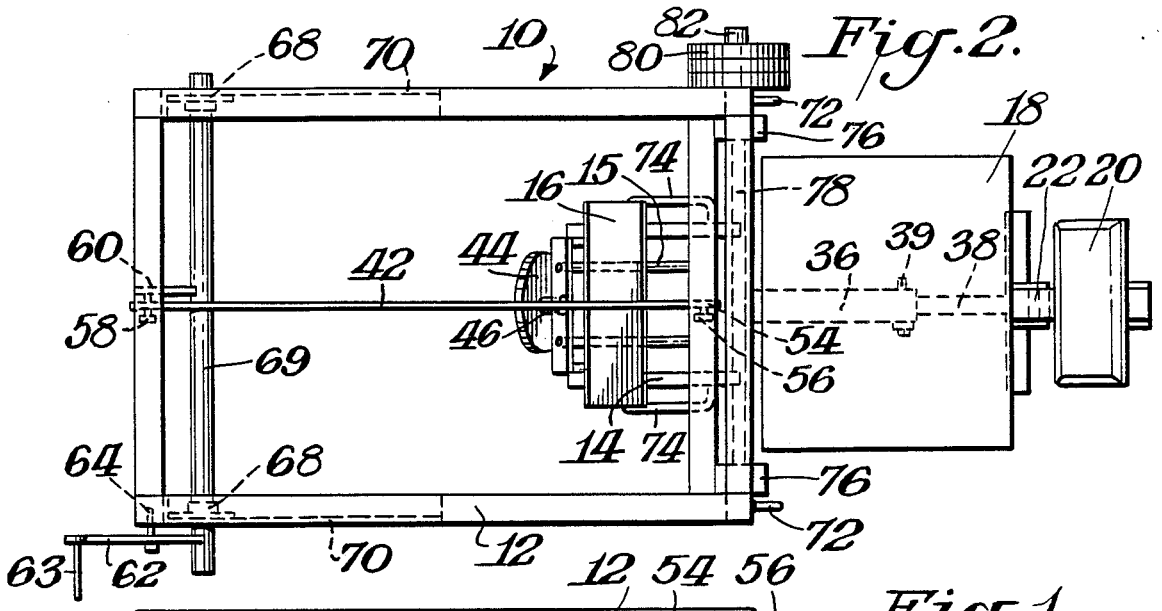
FIG. 2 is a top plan view of the apparatus shown in FIG. 1.

FIG. 2 is a top plan view of the apparatus 10 shown in FIG. 1. Therein, platform 18, with support member 22 and padded backrest 20 are affixed to frame 12 by means of horizontal adjustment members 36 and 38, held in place by pin 39. Foot slide block means 16 slides on round rods 15 which are held by brackets 14. Additional weight 44 is shown affixed to the slide assembly in phantom. Stretch lever 62 having handle 63 is set at the desired position and held there by pin 64 inserted into support bracket 70. Chain 42 passes over idler 58 and thence back to foot slide block means 16. Handles 72 and 74 are shown for completeness.

FIGS. 3 and 4 are front and rear elevations, respectively, of the apparatus 10. Therein the relative positions of platform 18 having backrest 20 and the slide assembly are more clearly indicated. Foot slide block means 16 slides on slide rods 15 which, in turn, are held in place by slide assembly brackets 14. Cross-support member 77 supports end bearings 76 and bearing rod 78. Additional weights 80 are held on frame 12 by pins 82.

Figure 5:
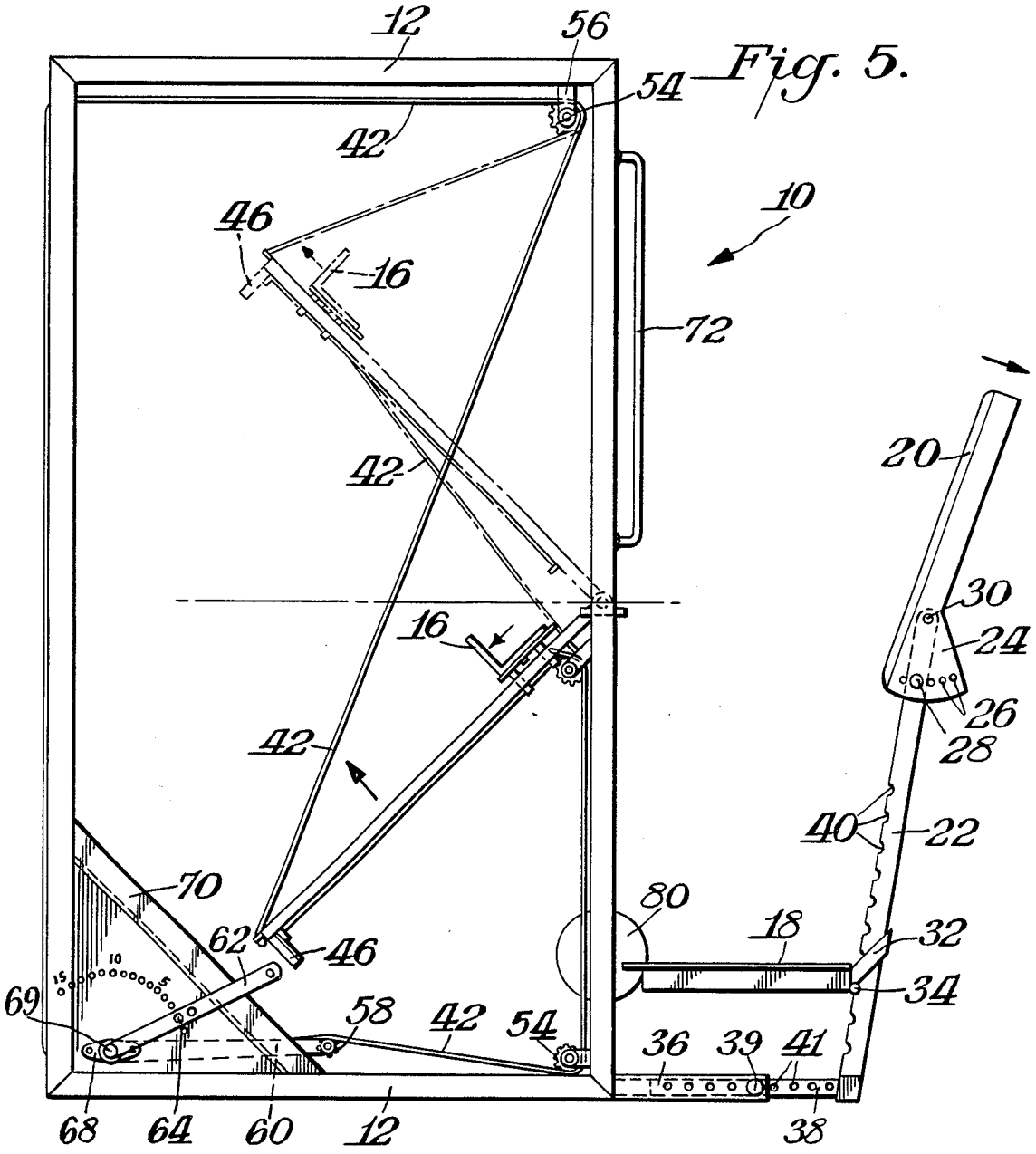
FIG. 5 is a side elevation of the apparatus according to the invention in the least difficult configuration in which to exercise.

FIG. 5 shows apparatus 10 in the configuration which is the least demanding of the user. Therein, stretch lever 62 has been placed so as to reduce the tension in chain 42 to the minimum, as determined by the position of take-up arm 60. The platform 18 and backrest 20 are adjusted as before, and desired weights may be added. The user begins at an initial position shown in solid lines in which the slide assembly extends outwardly and downwardly from the user at an angle of about 45°. The user places his foot in foot slide block means 16 and gives a kick, indicated by the arrow. The foot slide block assembly moves outwardly away from the user and the slide assembly rotates upwardly as indicated by the arrow to a final position shown in phantom in which the slide assembly extends outwardly and upwardly from the user at an angle of about 45°. It should be noted that, in any position, except the maximum, additional stretch can be imposed on the user by a second person disengaging pin 64 and manually adjusting stretch lever 62 to a higher tension position.

FIG. 6 is a view taken substantially along line 6—6 of FIG. 1. Foot slide block means 16 is affixed to slide bearings 52 by swivel mechanism 50. Slide bearings 52 slide on bearing rods 15 extending therethrough. The swivel means 50 enable the foot slide block assembly 16 to move as indicated by the arrows, giving some additional flexibility to the user's foot movement. Additional weight block 44, weight bolt 46, nut 48 and spacer 45 are shown for clarity.

When a beginner uses the apparatus, he should adjust the platform for proper inseam height so that the crotch is slightly above the rotatable slide assembly as follows: Adjust the backrest inwardly or outwardly for comfort. Then adjust the vertical backrest for the proper amount of forward lean, depending on flexibility. Adjust the preset stretch lever to the maximum level that will allow the user to fully extend his leg and obtain a good stretch. Once all of these variables are properly set, one should practice several kicks on each leg. To progress from beginner to advanced, one should try to pull himself inwardly and over the leg being exercised. When he is able to grasp the handles on the slide assembly, the preset stretch angle may be increased to a higher number and repeat the above instructions. One should continue this process until the user can stand in the apparatus with the preset lever at the maximum setting. Once this position is reached, or at any time prior to this, the user may add weights according to flexibility and strength.

It should be noted that at any time during the process, if the user cannot obtain the maximum vertical position, he may have another person remove pin 64 from the preset stretch lever and pull the lever to a higher number, thereby obtaining extra stretch until the desired level is reached.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Apparatus useful in practicing a karate kick comprising:

(a) a frame, (b) a vertically adjustable platform affixed externally to said frame, (c) a rotatable slide assembly having a forward end and a rear pivot end, the rear pivot end affixed to said frame adjacent said platform, the slide assembly extending internally within said frame, (d) foot slide block means slideably engaged in said slide assembly so as to slide from an initial rest position adjacent said rear pivot end to a final fully-extended position adjacent said forward end of said slide assembly, and (e) resistance means comprising a tension member and pulley assembly affixed to said slide block assembly and to said frame which resist movement of said slide block assembly from said initial rest position to said final fully-extended position, whereby, when a user stands on one foot on said platform, suitably adjusted for said user's height, and places his other foot on said foot slide block means in said initial position and gives a kick, said slide block means slides in said slide assembly to said final position restrained by said resistance means, said resistance means acting to rotate said slide assembly upwardly about a horizontal pivot axis thereby giving the user exercise for those muscles specifically associated with the kick.

2. The apparatus of claim 1 wherein said tension member and pulley assembly has one end of said tension member affixed to said forward end of said rotatable slide assembly, said tension member being directed from said forward end upwardly to and through a pulley affixed to said frame, thence directed around said frame through one or more pulleys downwardly, and then returning upwardly to said foot slide block means, the other end of said tension member being affixed thereat.

3. The apparatus of claim 1 having means for adjusting said rotatable slide assembly to an initial rest position extending outwardly and downwardly from said user at an angle of about 45°.

4. The apparatus of claim 1 having means for adjusting said rotatable slide assembly to an initial rest position extending outwardly and horizontally from said user.

5. The apparatus of claim 1 having means for adjusting said rotatable slide assembly to an initial rest position extending outwardly and upwardly from said user at an angle of about 45°.

6. The apparatus of claim 1 having at least one weight affixed to said forward end of said rotatable slide assembly.

7. The apparatus of claim 6 having a plurality of weights affixed to said forward end of said rotatable slide assembly.

8. The apparatus of claim 1 wherein said platform is horizontally adjustable.

9. The apparatus of claim 1 wherein said platform has a generally upwardly oriented, padded backrest affixed thereto.

10. The apparatus of claim 9 having means for adjusting the slant angle of said backrest with respect to the vertical.

11. The apparatus of claim 1 wherein said foot slide block means has swivel means.

* * * * *